US006163888A

United States Patent [19]

Park

[11] Patent Number: 6,163,888

[45] **Date of Patent: *Dec. 26, 2000**

[54] FREE-SIZE HAT

[75] Inventor: Boo Yi Park, Seoul, Rep. of Korea

[73] Assignee: Dada Corporation, Seoul, Rep. of Korea

[ * ] Notice: This patent is subject to a terminal disclaimer.

[21] Appl. No.: 09/332,002

[22] Filed: Jun. 14, 1999

[51] Int. Cl.[7] ..... A42B 1/22

[52] U.S. Cl. ..... 2/183; 2/195.3

[58] Field of Search ..... 2/195.2, 195.3, 2/181, 183, 417, 418, 195.1, 175.1

[56] References Cited

U.S. PATENT DOCUMENTS

| | | | |
|---|---|---|---|
| 1,663,124 | 3/1928 | Fisher | 2/195.2 |
| 1,981,286 | 11/1934 | Reynolds | 2/195.2 |
| 2,057,915 | 10/1936 | Probst | 2/195.2 |
| 4,101,981 | 7/1978 | Boden . | |
| 4,468,815 | 9/1984 | Pellegri . | |
| 4,815,148 | 3/1989 | Satterfield . | |
| 5,103,503 | 4/1992 | Fekete, Sr. . | |
| 5,269,026 | 12/1993 | McManus . | |
| 5,669,076 | 9/1997 | Steffy . | |
| 5,822,799 | 10/1998 | Kepple . | |
| 6,016,572 | 1/2000 | Park | 2/195.2 |
| 6,052,831 | 4/2000 | Park | 2/195.2 |

*Primary Examiner*—Bibhu Mohanty
*Attorney, Agent, or Firm*—Jacobson, Price, Holman & Stern, PLLC

[57] ABSTRACT

A free-size hat is capable of fitting wearers having a range of head sizes. The free-size cap including both cap and hat regardless of the fabric can provide a free-size function by accommodating various head sizes of the wearers with slits being formed on the crown and the brim. The structure of the present invention permits either a hat or a cap to be designed which is produced easily, attractive in use or other time by keeping shape, comfortable for the wearer by causing no oppression, and further provides the advantageous feature of multiple size capability.

8 Claims, 5 Drawing Sheets

FREE-SIZE HAT

FIELD OF THE INVENTION

The present invention relates generally to an improved hat structure, and more particularly to an improved free-size hat having a typical hat configuration. The free-size hat is capable of fitting wearers having a range of head sizes.

BACKGROUND OF THE INVENTION

It shall be understood that various style of hats are marketed in a variety of ways. These hats are marketed through conventional retail outlets, and have also found a substantial market as promotional items. In the marketing of outerwear products, it is, of course, more economical to provide such products in a minimal numbers of sizes. Thus, economy of numbers may be achieved through utilization of hats of the multi-size variety.

In addition to typical marketing, various types of business entities provide such promotional items to employees and/or customers, and in these instances, the outer surface of the crown at a point above the visor may carry an emblem, or other indicia identifying the business entity. Because of the manner in which these products are marketed, it is, of course, desirable to utilize the products with minimal size variation requirements, hence the free-size hats become extremely desirable for the customer.

As is conventional, hats employ a crown portion to which a brim is secured to the forward edge of the crown and extends outwardly therefrom.

In the past, attempts have been made to provide free-size hat structures of the conventional hat style. Typically, the function of free-size is created through the utilization of an elastic band and of a stretchable fabric on the part of a crown and a brim. However, such hats cause a sense of oppression to the wearer since it uses a highly elastic band, especially when the wearer of a bigger head size wears the hat of a smaller crown size.

For instance, U.S. Pat. No. 5,822,799 teaches construction of a crown made in a big size, and a sweatband being stitched inside the crown at a level with a brim to provide a size-adjustment function as the wearer's head is received into the crown. A sweatband inside the said crown is pulled up in order to adjust to the wearer's head size. However, this does not provide a comfortable fitting to the wearers as the area in which the forehead of the wearer and the sweatband meets is higher than the area found in the typical configuration of the hat.

SUMMARY OF THE INVENTION

It is therefore desirable to provide a cap which is more simply produced, attractive in use, comfortable for the wearer by causing no oppression, and further provides the advantageous feature of multiple size capability. Such cap designs are utilized by individuals for a variety of outdoor purposes, including work purposes as well as sport purposes, including such sports as hunting, fishing and the like.

It is a primary object of the present invention to provide an improved hat for fitting multiple sizes which includes slits on the part where the sense of oppression is felt as the wearer wears the hat smaller than his/her head size.

It is a further object of the present invention to provide a hat structure capable of multi-size use, which can be manufactured easily utilizing conventional materials and fabrics, and which is both functional and attractive in its use and appearance.

It is yet a further object of the present invention to provide an improved free-size hat structure which employs the crown divided into more than one panel, stretchable bias tapes connecting each panels, and a brim with slits to avoid oppression to the wearer's head and each panel having different color and fabric to make a fashionable hat.

It is still a further object of the present invention to decrease the manufacturing process and the quantity of stock in a manufactory or in a selling agency due to the wider accommodation range of the hat.

In order to achieve the foregoing objects, the present invention provides a free size hat comprising a main body having a plurality of panels forming a crown portion with a lower peripheral edge. At least some of said plurality of panels are connected by stretchable material aligned to stretch at least in the peripheral direction so that the material functions as a flexible seam. An unfolded sweatband is attached to said inner lower peripheral edge of said crown portion to which the brim is attached. The brim is cut into slits to accommodate a wide range of head sizes wherein a length, a number, and a position of slits are made to look agreeable with the whole appearance of the hat. The slits of the brim are connected by using the stretchable material or not connected to make it look more natural. The color of the bias tapes is different from the color of the crown or a brim to make the hat look more attractive. More than one panel may be made of stretchable material to further improve the expandability of the hat.

Other and further objects of the present invention will become apparent to those skilled in the art on consideration of the accompanying drawings and following specification wherein are disclosed several exemplary embodiments of the invention with the understanding that such variations, modifications and elimination of parts may be made therein as fall within the scope of the appended claims without departing from the spirit of the invention.

| LIST OF PARTS | |
|---|---|
| B | non-stitched blank section |
| X | latitudinal elongation |
| Y | longitudinal elongation |
| 1 | crown |
| 2 | brim |
| 3 | sweat band (elastic band) |
| 4 | bias tape (mesh span or stretchable material) |
| 5 | visor stitch |
| 6 | each panel forming a crown |
| 7 | each panel forming a crown |
| 8 | each panel forming a crown |
| 9 | part where slits of brims are sewn together |
| 10 | a thin, narrow elastic material |
| 11 | button hole hemmed by a thread |
| 12 | stretchable material |
| 13 | inner extended brim with multiple number of slits |
| 14 | elastic band of small size |
| 15 | sweatband (woven) |
| 16 | stitch line |
| 17 | visor |
| 18 | top button |
| 19 | eyelet |
| 20 | inner folded portion of the lower peripheral edge of the crown serving as a sweatband |
| 21 | sponge |
| 22 | drawing of an outer configuration of free-size hat |

DESCRIPTION OF THE PREFERRED EMBODIMENTS

In the present invention, as the most distinguishable feature, the hat is incised to accommodate various head sizes. The incisions are made at locations where the sense of oppression is felt when wearers wear a hat smaller than their head sizes. The crown 1 and brim 2 are preferably formed by non-stretchable material.

First Embodiment

In accordance with the first preferred embodiment of the present invention, and with particular attention directed to FIGS. 1–4, a free-size hat structure generally designated by 22 includes a crown 1 which is fabricated with several fabric segments (panels or gores) 6, 7, and 8. Secured to the outer lower portion of the crown is a brim 2 extending away from the crown 1 with a brim stitch 5.

The crown and the brim are formed of individual panels such as panels 6, 7, 8, and 2 which are fabricated with normal woven fabric such as mesh spandex or stretchable fabric.

Figure 3:
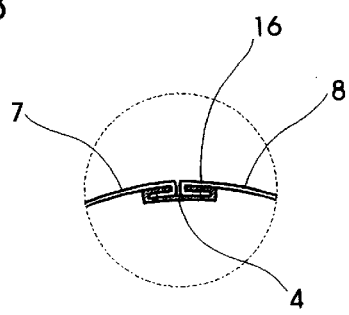
FIG. 3 is a cross sectional view of a stitch at section C of FIG. 1.
Figure 4:
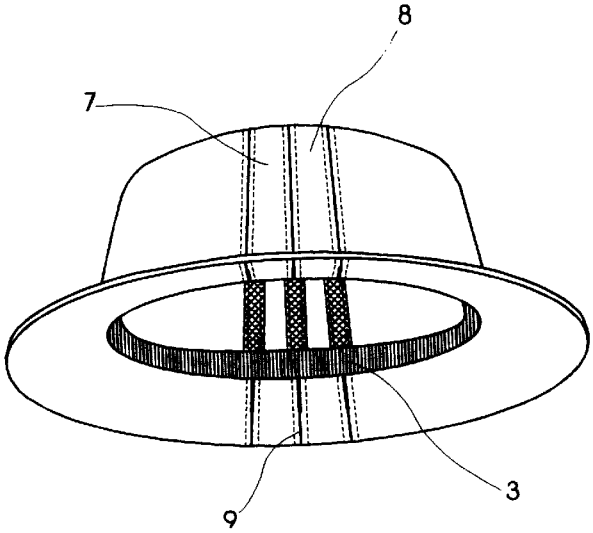
FIG. 4 is a bottom perspective view of the hat of FIG. 1.

At least panels 6, 7, and 8 are connected uniaxially- or biaxially- by stretchable fabric or tape 4 to form seam 4. The tape may be sewn at 16 with said panels in a manner shown in FIG. 2. Any other way of connecting said panels and said tape could be used as long as each side of the tape is secured firmly at each side of the panels. The width of said tape 4 is not limited to a certain length. The color of said tape may be matched to the color of said panels. However, it is still possible to adopt said tape of different color so that it appears as a contrast piping. Therefore, the panels 6, 7, and 8 can be of different colors. FIG. 3 shows an enlarged cross-sectional view when said panel and said stretchable tape are sewn.

Figure 1:
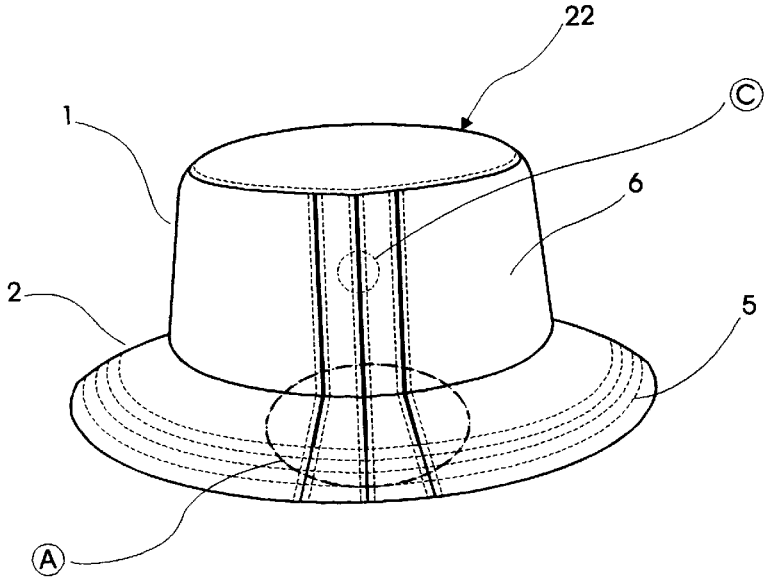
FIG. 1 is a top perspective view of a free-size hat in accordance with a first preferred embodiment of the invention.
Figure 2:
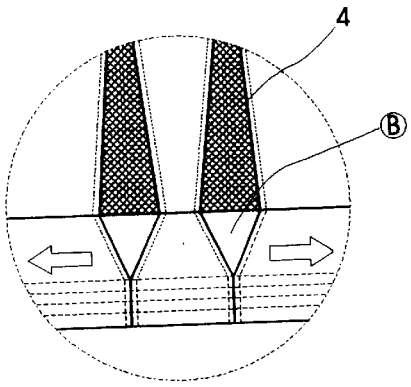
FIG. 2 is an enlarged view of section A of FIG. 1, with the slits expanded.

The slits B on said brim 2 are left blank to maintain its function and aesthetic appearance. Likewise, the same result can be attained for the brim by stitching stretchable material to slits fashioned in the brim. A length of the stitched part of the slits 9 where the divided brims are sewn together is approximately one-half of a width of said brim, but it can be readjusted if necessary. FIG. 1 shows the brim stitch 5 being stitched up to the stitched part 9 of said brim, but this also can be readjusted if necessary.

The lower peripheral edge of said crown can be finished with an elastic headband 3 in a conventional way. The headband 3 is preferably fabricated with material capable of absorbing sweat or the like and of providing elasticity.

Second Embodiment

Figure 5:
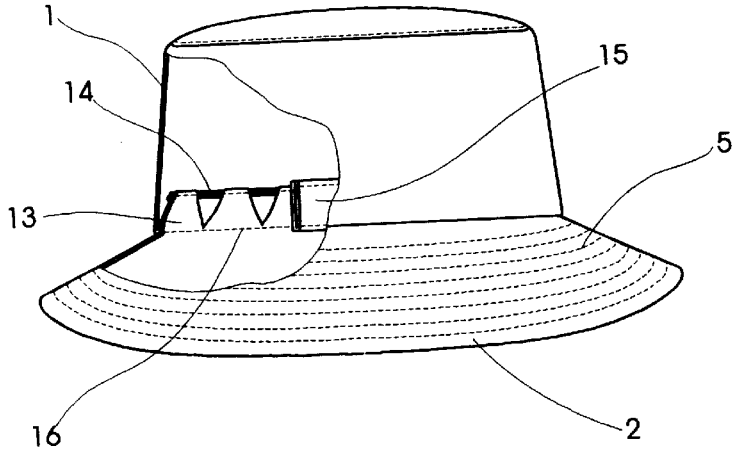
FIG. 5 is a perspective view of a free-size hat in accordance with a second preferred embodiment of the invention.

In accordance with another preferred embodiment of the present invention, and with particular attention directed to FIG. 5, an alternative preferred embodiment of the hat consisting of slits is shown. It is desirable to accommodate various head sizes without changing a general shape of the hat. Preferably, the crown and the brim of the hat are made of a non-stretchable fabric.

As shown in FIG. 5, the brim is connected to a lower peripheral edge of the crown 1 with the inner width of the extended brim being less than the width of the sweatband. The upper edge of the inner extended brim 13 is not stitched to the inner surface of the crown, but the intersecting part of said crown and said brim are stitched at line 16. The inner extended brim 13 has multiple slits formed along the upper edge of the inner extended said brim. A thin, narrow elastic band 14 is attached to the upper edge of the inner extended brim 13. The width of the band 14 is less than the width of said brim 13.

A sweatband 15, which is preferably fabricated with material capable of absorbing the sweat or the like, is stitched along the inner periphery of said crown 16.

Figure 6:
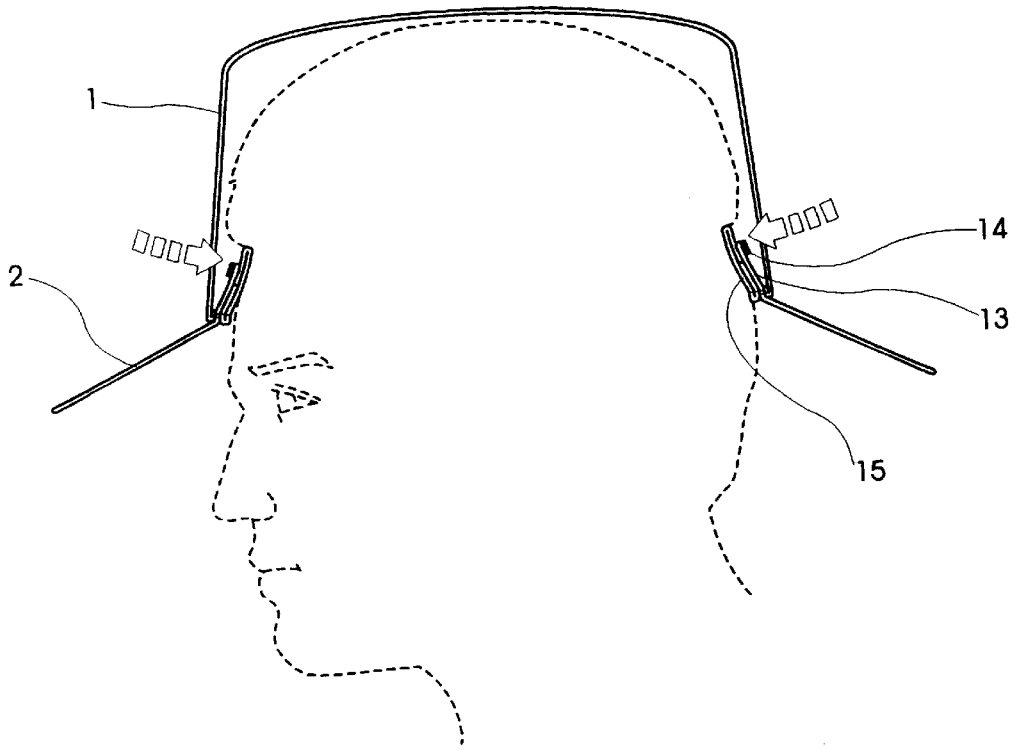
FIG. 6 is a cross-section of the hat in FIG. 5 shown on a user's head.

As the wearer wears the hat, the thin, narrow elastic band 14 expands according to the wearer's head size to provide a comfortable fitting. FIG. 6 shows a configuration of the hat when it is worn by the wearer.

Third Embodiment

Figure 7:
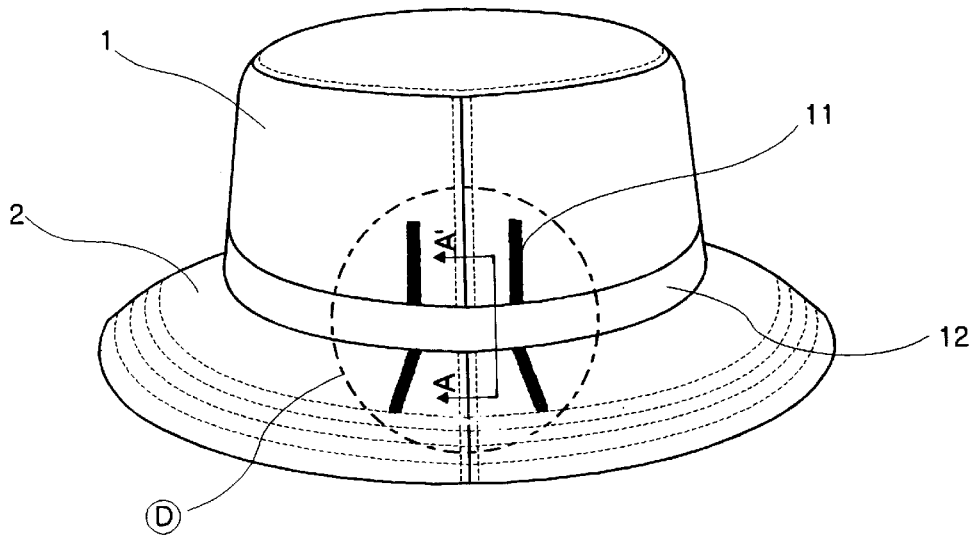
FIG. 7 is a perspective view of a free-size hat in accordance with a third preferred embodiment of the invention.

FIG. 7 shows another alternative preferred embodiment of the hat consisting of slits. The panels forming the crown 1 and the brim 2 are preferably formed by a non-stretchable fabric. If the wearer wears a hat which is smaller than his/her head size, it can cause a sense of oppression to the wearer as the hat cannot be stretched. However, if the hat has slits, the sense of oppression is greatly reduced.

With particular attention directed to FIG. 7, more than one slit is formed on both sides of said crown 1 and said brim 2. The length of slits are preferably about one-half of the length of said brim respectively. The length and the number of the slits are not limited to any certain length and it can change freely. In addition, the slits on said crown and said brim do not necessarily have to be equal in number or size.

Figure 8:
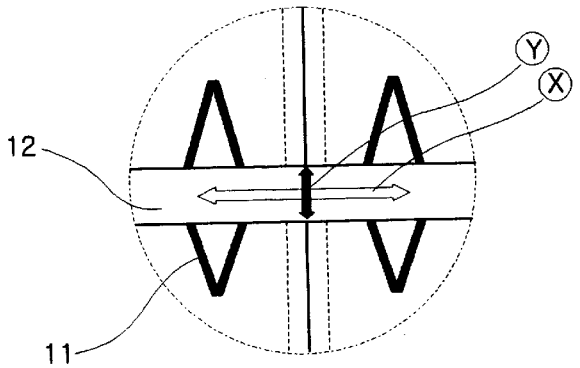
FIG. 8 is an enlarged view of section D of FIG. 7 with the slits expanded.
Figure 9:
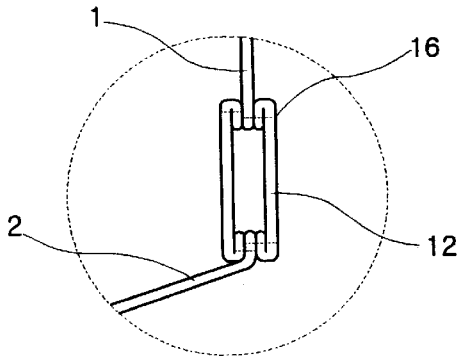
FIG. 9 is a perspective view taken along line A-A' of FIG. 7.

Crown 1 and brim 2 are stitched respectively to a stretchable material 12 which is situated in-between the crown and brim. The stretchable material 12 is at least uniaxially stretchable in the peripheral direction X. However, the stretchable material 12 may also stretch in the latitudinal direction Y, as shown in FIG. 8. In the FIG. 9, the cross-sectional view of the stretchable material 12, said crown and said brim are seen. The stretchable material 12 preferably also absorbs sweat and the like to serve as a sweatband. The hole 11 created by the slit can be left blank or can be stitched with the stretchable material.

The complete configuration of the hat is shown in the FIG. 7. The FIG. 8 shows the expandability of the hat the wearers wear the hat which is otherwise smaller than their head sizes.

Fourth Embodiment

Figure 10:
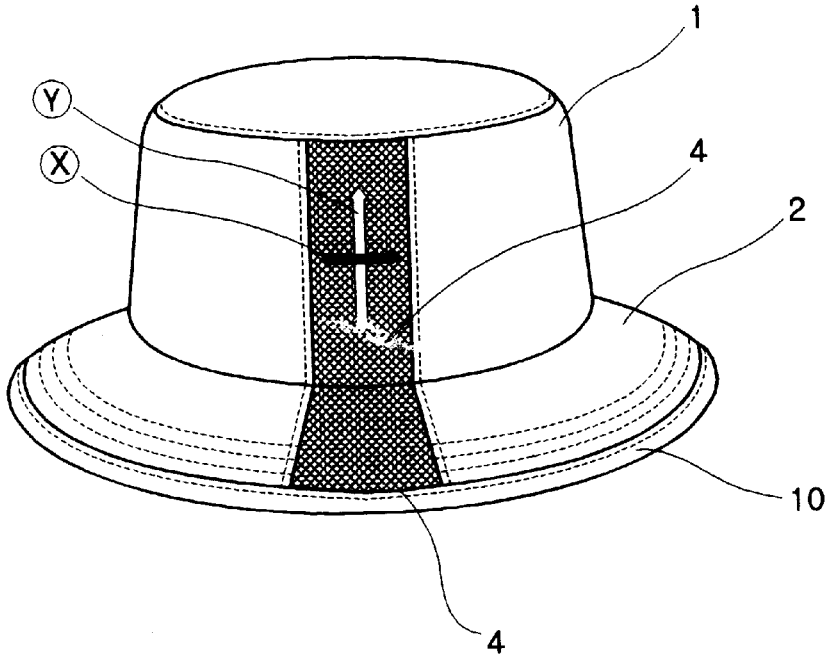
FIG. 10 is a top perspective view of a free-size hat in accordance with a fourth preferred embodiment of the invention.
Figure 11:
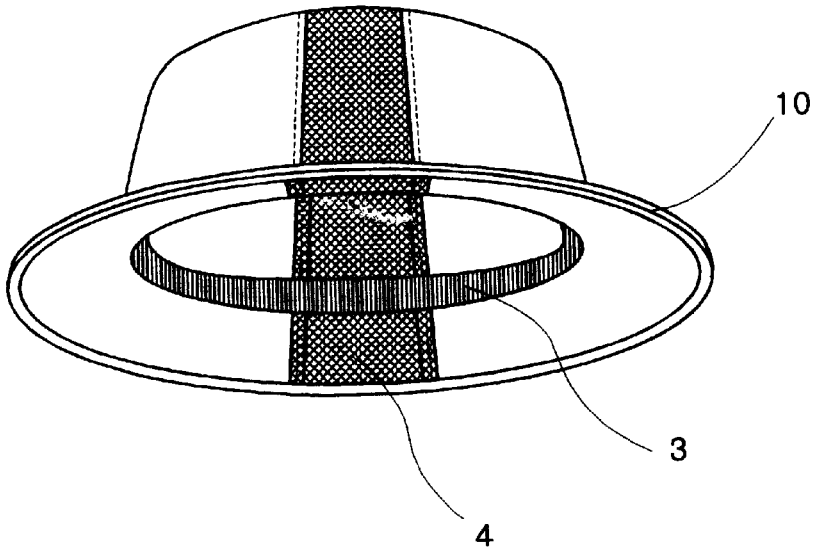
FIG. 11 is a bottom perspective view of the hat in FIG. 10.

Another alternative preferred embodiment of the hat consisting of slits is shown in FIGS. 10 and 11. The crown 1 and the brim 2 are preferably formed by non-stretchable fabric, wherein mesh span or stretchable material 4 can be attached to more than one part of the slits on said crown and said brim to provide a hat which stretches effectively to accommodate various head sizes of the wearers.

A conventional method may be used to stitch elastic band 3 to the inner surface of said crown. The lower peripheral edge of the brim 2 is stitched by a thin, narrow stretchable material 10 that stretches with mesh 4. For aesthetic appearance of the hat, the entire peripheral edge is stitched with material 10. The stretchable material 4, 10 stretches at least in the peripheral direction X, but may also stretch latitudinally Y.

Fifth Embodiment

Figure 12:
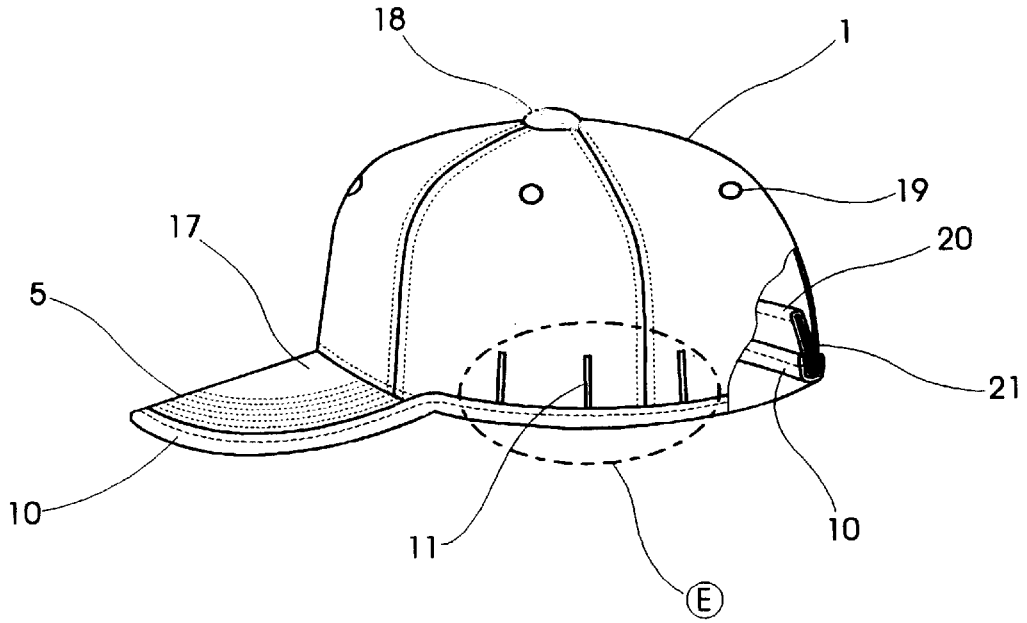
FIG. 12 is a perspective view of a free-size hat in accordance with a fifth preferred embodiment.

It shall be noted that even though the invention is described only for a hat in the above stated embodiments, the technical concept of the present invention is also applicable to the typical hat or cap with gores to carry out the free-size function as shown in FIG. 12.

The cap is formed by a multiple number of gores, the crown 1 is made by either stretchable or non-stretchable fabric, top button 18, eyelet 19, and a rigid visor 17 attached to the front of the cap.

In order to apply the technical concept of the hat comprising slits to the cap with multiple-gores, the fabric band is preferably formed by folding the lower peripheral edge of said crown more than once inside having a width the same as the normal headband. Inside said folded fabric band 20, a sponge 21 or a similar elastic sweat absorbing material can be stored. The sponge 21 is secured to the fabric using elastic thread. The folded fabric band 20 eliminates the need for a separate headband.

A sweat absorbing band is attached to the inner edge of the visor 17, and touches the wearer's forehead. The visor 17 is rigid and non-stretchable, so that the width of said sweat absorbing band is less than the normal headband.

With the exception of the front part of said cap to which the visor is attached, the technical concept of slits can be applied to both sides and the back portion of said cap to accommodate various head sizes and to provide an aesthetic appearance. The number and the length of said slits can vary which means said slits can have the shape of various figures such as a tooth of an animal or the fishes to reinforce the free-size function and the aesthetic appearance.

A thin, narrow stretchable material 10 may be stitched along the outer edge of said visor and the lower peripheral edge of said crown. The material 10 stretches with the slits and also covers the unsightly tuck formed by slits in the said crown. The colors of the stretchable material 10 and the button hole can be either solid and may also be different than the color of the crown 1.

Figure 13:
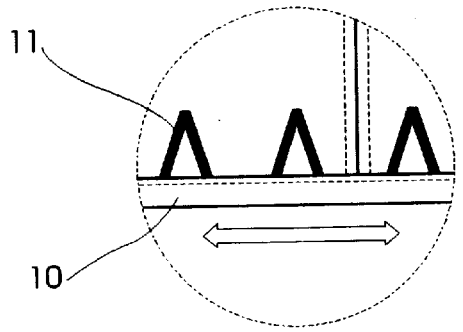
FIG. 13 is an enlarged view of section E of FIG. 1.

FIG. 13 shows the expandability of the invention as the wearer wears the cap that would otherwise be smaller than their head sizes.

We claim:

1. A free-size hat comprising a main body having a plurality of panels forming a crown with a lower peripheral edge wherein a sweat absorbing elastic band is attached to said lower peripheral edge of said crown to which a brim is attached; and at least two of said plurality of panels are connected to each other at a seam by using a stretchable material aligned to stretch at least in the peripheral direction; and said brim having slits that are at least partially stitched and partially non-stitched, and said seam and the non-stitched slits of the brim are expandable to accommodate various head sizes.

2. The free-size hat as claimed in claim 1, wherein said panels and said brim are fabricated by a non-stretchable fabric.

3. The free-size hat as claimed in claim 1, wherein said panel and said brim are fabricated by stretchable material.

4. The free-size hat as claimed in claim 1, wherein said plurality of panels forming said crown portion and said seam connecting at least one of said plurality of panels to a neighboring one of said plurality of panels.

5. The free-size hat as claimed in claim 4, wherein said seam is stretchable at least in a peripheral direction.

6. The free-size hat as claimed in claim 1, wherein a portion of said brim is cut into slits to stretch in a peripheral direction.

7. The free-size hat as claimed in claim 1, wherein an elastic band is fabricated by a sweat-absorbent.

8. The free-size hat as claimed in claim 1, wherein said seam comprises stretchable tape.

* * * * *